US010769992B2

(12) United States Patent
Li et al.

(10) Patent No.: US 10,769,992 B2
(45) Date of Patent: Sep. 8, 2020

(54) DISPLAY PANEL, DRIVING METHOD, AND DISPLAY DEVICE

(71) Applicant: SHANGHAI TIANMA AM-OLED CO., LTD., Shanghai (CN)

(72) Inventors: Yue Li, Shanghai (CN); Dongxu Xiang, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 226 days.

(21) Appl. No.: 15/591,906

(22) Filed: May 10, 2017

(65) Prior Publication Data

US 2017/0243539 A1 Aug. 24, 2017

(30) Foreign Application Priority Data

Jan. 5, 2017 (CN) ..... 2017 1 0006638

(51) Int. Cl.
*G09G 3/3233* (2016.01)

(52) U.S. Cl.
CPC ... *G09G 3/3233* (2013.01); *G09G 2300/0809* (2013.01); *G09G 2310/06* (2013.01); *G09G 2320/045* (2013.01); *G09G 2330/12* (2013.01); *G09G 2360/16* (2013.01)

(58) Field of Classification Search
None
See application file for complete search history.

(56) References Cited

U.S. PATENT DOCUMENTS

2005/0116747 A1* 6/2005 Shimoda ..... G09G 3/3283 327/108
2011/0122119 A1* 5/2011 Bae ..... G09G 3/3233 345/211
2013/0334527 A1* 12/2013 Umezaki ..... G09G 3/20 257/43
2014/0347253 A1* 11/2014 Lee ..... G09G 3/3233 345/76
2016/0300534 A1* 10/2016 Kishi ..... G09G 3/3233

FOREIGN PATENT DOCUMENTS

CN 105913801 A 8/2016

OTHER PUBLICATIONS

Chinese, 1st Office Action dated Jun. 15, 2018.

* cited by examiner

*Primary Examiner* — Stephen T. Reed
(74) *Attorney, Agent, or Firm* — Alston & Bird LLP

(57) ABSTRACT

The present application discloses a display panel and a display device. The display panel comprises a plurality of data signal lines; a plurality of scan signal lines intersecting with the plurality of data signal lines, to define a plurality of sub-pixels in an array, and each of the sub-pixels comprising a pixel driving circuit, and an external compensation circuit, comprising a power supply unit, a sampling unit and a data signal generation unit, being connected to the data signal lines, and transmitting a compensated data signal via the data signal lines to the pixel driving circuits. In the present implementation, voltage compensation is performed by the external compensation circuit on the driving transistor and the organic light emitting diode in the pixel driving circuit, to improve the driving capability of the pixel driving circuit and increases the display precision of the display panel.

15 Claims, 8 Drawing Sheets

DISPLAY PANEL, DRIVING METHOD, AND DISPLAY DEVICE

CROSS-REFERENCE TO RELATED APPLICATION

This application is related to and claims priority from Chinese Patent Application No. CN201710006638.X, filed on Jan. 5, 2017, entitled "Display Panel, Driving Method and Display Device", the entire disclosure of which is hereby incorporated by reference for all purposes.

TECHNICAL FIELD

This disclosure generally relates to the field of display technologies, and particularly to a display panel, a driving method applied in the display panel, and a display device.

BACKGROUND

Organic light emitting diode (OLED) is a display technology making use of the reversible color changes produced in an organic semiconductor material when driven by a current. The existing organic light emitting diodes can be divided into passive matrix OLEDs (PMOLEDs) and active matrix OLEDs (AMOLEDs), based on the driving modes. In a pixel driving circuit, compared with a passive matrix, the pixels in an active matrix can emit light simultaneously, reducing the luminous brightness of individual pixels, such that the deficiency that the brightness of the organic light emitting diode needs to be increased in the passive matrix is alleviated, the powder consumption of the circuits is reduced, and high-resolution display is achieved. Meanwhile, colorization and large-area display can be easily realized with the active matrix.

The organic light emitting diode is a current-type organic light emitting diode, which is driven by a current generated by a thin-film transistor in a saturation state to emit light, and the brightness is proportional to the current flowing through the organic light emitting diode. In a conventional active pixel driving circuit, threshold compensation on the driving transistor is generally accomplished by an internal structure of the circuit itself. However, after a long-term operation, power consumption, steady current, operating voltage and other parameters of the organic light emitting diode change or degrade, so that the compensation for the working parameters of the organic light emitting diode is difficult to achieve with an internal compensation circuit.

In view of the defects or disadvantages existing in the prior art, it is desirable to provide a display panel, a display device, and a method for driving a pixel driving circuit applied to the display panel, to solve the technical problems existing in the prior art.

SUMMARY

In a first aspect, an embodiment of the present application provides a display panel. The display panel comprises a plurality of data signal lines; scan signal lines in intersecting arrangement with the data signal lines, the data signal lines intersecting the scan signal lines to define a plurality of sub-pixels in an arrayed configuration, and each of the sub-pixels comprising a pixel driving circuit; and an external compensation circuit, comprising a power supply unit, a sampling unit and a data signal generation unit, being connected to the data signal lines, and transmitting a compensated data signal via the data signal lines to the pixel driving circuits, the pixel driving circuit comprising a driving transistor and an organic light emitting diode, the power supply unit being configured to provide a current signal to the driving transistor and/or the organic light emitting diode; the sampling unit sampling a voltage signal of the driving transistor and/or the organic light emitting diode based on the current signal provided by the power supply unit, and comparing the voltage signal with a pre-stored characteristic curve of the driving transistor and/or a characteristic curve of the organic light emitting diode to determine a degraded voltage of the driving transistor and/or the organic light emitting diode; and the data signal generation unit generating the compensated data signal based on the degraded voltage of the driving transistor and/or the organic light emitting diode determined by the sampling unit, and providing the compensated data signal to the pixel driving circuits.

In a second aspect, an embodiment of the present application provides a method for driving the display panel. The display panel includes an external compensation circuit for compensating the pixel driving circuit, a scan signal line, a light emission control signal line, and a detection signal line, the external compensation circuit comprises a power supply unit, a sampling unit, and a data signal generation unit, the pixel driving circuit comprises a data write unit, a threshold compensation unit, a light emission control unit, a driving transistor, and a light emitting diode, and the method comprises: in a threshold detection phase, the power supply unit transmitting a current signal to the driving transistor and the organic light emitting diode in a time division mode, the sampling unit sampling a threshold voltage of the driving transistor and a voltage between two terminals of the organic light emitting diode and determining a threshold voltage and mobility of the driving transistor and a voltage of the organic light emitting diode based on the current value transmitted from the power supply unit, and the data signal generation unit determining a compensated data signal based on the threshold voltage, the mobility and the voltage of the organic light emitting diode determined by the sampling unit; in a data write phase, the data signal generation unit transmitting the compensated data signal to the data signal line, and the data write unit transmitting the compensated data signal to the gate of the driving transistor based on a signal transmitted from the scan signal line, so that the pixel driving circuit accomplishes writing of data; and in a light emission phase, the data write unit being turned off based on a signal transmitted from the scan signal line, the light emission control unit being turned on based on a signal transmitted from the light emission control signal line, and the driving transistor providing a light emitting current to the organic light emitting diode so that the organic light emitting diode emits light.

In a third aspect, an embodiment of the present application provides a display device including a display panel as described above.

According to the embodiment of the present application, the threshold voltage of the driving transistor, and the voltage between two terminals of the organic light emitting diode can be compensated by arranging an external compensation circuit on the display panel, and a difference signal is set in the data signal and transmitted via the data signal line to the pixel driving circuit, such that the display precision is increased while the drive capability of the pixel driving circuit is improved.

BRIEF DESCRIPTION OF THE DRAWINGS

Other features, objects, and advantages of the present application will become more apparent upon reading the following description of the non-limiting embodiments in detail with reference to the accompanying drawings, in which.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1:
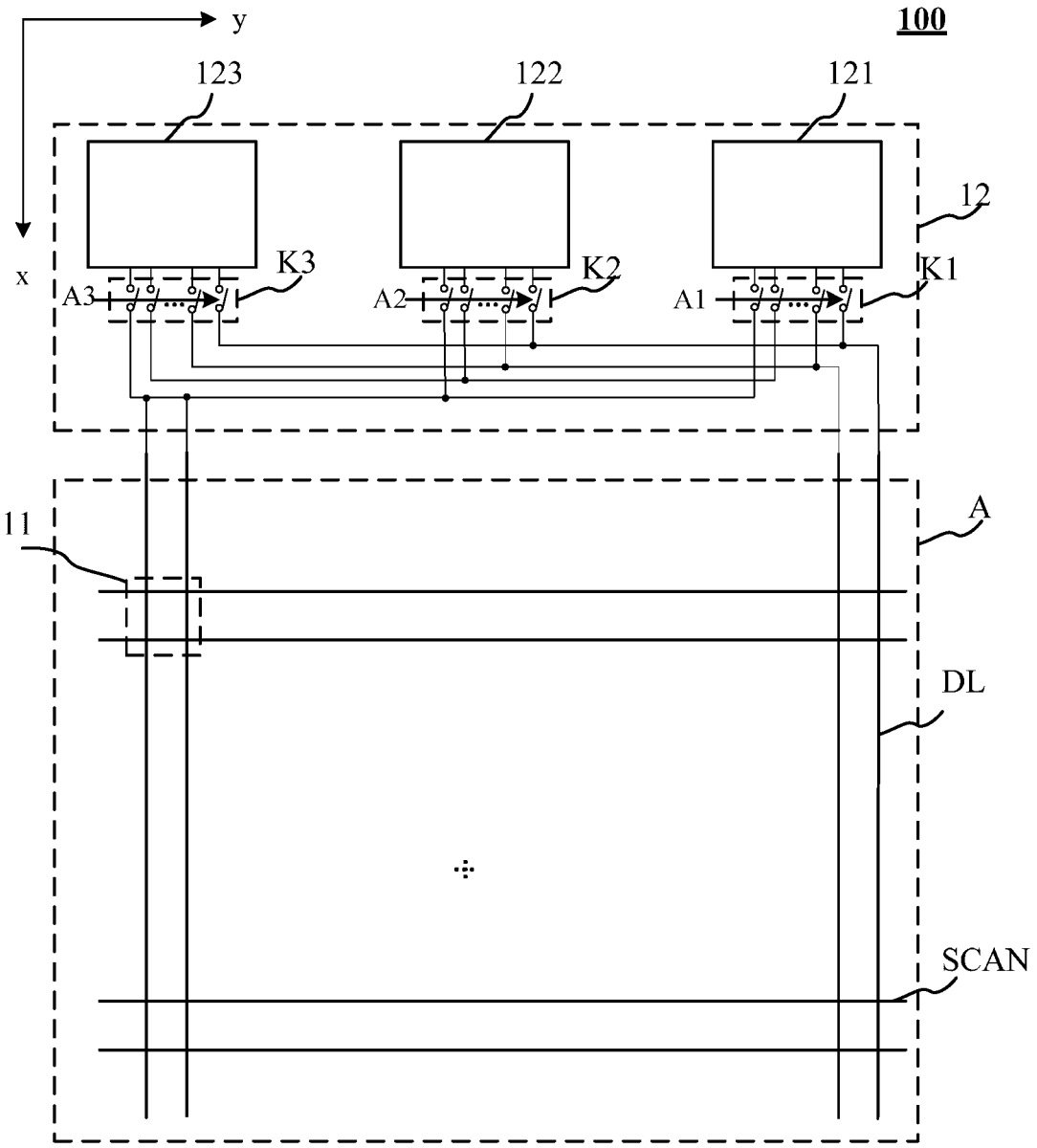
FIG. 1 shows a schematic structural diagram of a display panel provided in an embodiment of the present application.

FIG. 1 shows a schematic structural diagram of a display panel according to the present application. As shown in FIG. 1, a display panel 100 includes a display region A and a non-display region surrounding the display region. N data signal lines DL are arranged in the display region of the display panel 100, in which the data signal line DL extends along a first direction x. Scan signal lines SCAN in intersection arrangement with the data signal lines DL are also arranged in the display region of the display panel 100, in which the scan signal line SCAN extends along a second direction y. The data signal lines DL intersect with the scan signal lines SCAN to define a plurality of sub-pixels 11 in an arrayed configuration. Each of the sub-pixels includes an organic light emitting diode to emit light for display. In the sub-pixel 11, a pixel driving circuit is further arranged. A driving transistor is arranged in the pixel driving circuit and configured to provide a current signal needed by the organic light emitting diode for emitting light.

In the non-display region of the display panel 100 shown in FIG. 1, an external compensation circuit 12 is arranged. The external compensation circuit 12 is configured to provide a current to the pixel driving circuit, sample a voltage of the driving transistor and a voltage of the organic light emitting diode in the pixel driving circuit, and generate a compensated data signal based on the current and the sampled voltages. The external compensation circuit 12 is electrically connected to the data signal line DL, and transmits the compensated data signal via the data signal line DL to the pixel driving circuit in each of the sub-pixels 11 in the display region a.

In this embodiment, the external compensation circuit 12 includes a power supply unit 121, a sampling unit 122, and a data signal generation unit 123. A current source, a voltage source, and other power sources that can generate a current signal or a voltage signal can be arranged in the power supply unit 121 to output a current signal. The current signal can be transmitted via the data signal line DL to the pixel driving circuit, and acts on an input terminal of the organic light emitting diode and a control terminal of the driving transistor. Based on the current signal provided by the power supply unit 121 to the pixel driving circuit, the sampling unit 122 samples, via the data signal line DL, a voltage signal between the input terminal and an output terminal of the organic light emitting diode and a voltage signal between the control terminal and an output terminal of the driving transistor in the pixel driving circuit. An adder may also be arranged in the sampling unit 122, by which the voltages sampled from a plurality of pixel driving circuits connected to the same data signal line are summed and averaged. The data signal generation unit 123 generates a compensated data signal based on the signals sampled from the pixel driving circuit by the sampling unit 122, and transmits the compensated data signal via the data signal line DL to each of the pixel driving circuits.

In some optional implementations of this embodiment, an analog-to-digital converter may be further arranged in the external compensation circuit 12. The analog-to-digital converter can convert an analog signal sampled by the sampling unit into a digital signal, and transmit the digital signal to the data signal generation unit.

Optionally, a first switch unit K1, a second switch unit K2 and a third switch unit K3 are further arranged on the display panel 100. The first switch unit K1 includes a plurality of first switches, each of the first switches is connected between the power supply unit 121 and the data signal line DL, and each of the first switches is connected to a corresponding one of the data signal lines. The first switch unit K1 transmits the signal generated by the power supply unit 121 to each of the data signal lines DL, in response to a signal at a control terminal A1 thereof. The second switch unit K2 includes a plurality of second switches, each of the second switches is connected between the sampling unit 122 and the data signal line DL, and each of the second switches is connected to a respective one of the data signal lines DL. The second switch unit transmits the signal from the data signal line DL to the sampling unit 122, in response to a signal at a control terminal A2 thereof. The third switch unit K3 includes a plurality of third switches, each of the third switches is connected between the data signal generation unit 123 and the data signal line DL, and each of the third switches is connected to a respective one of the data signal lines DL. The third switch unit K3 transmits the signal generated by the data signal generation unit 123 to the data signal line DL, in response to a signal at a control terminal A3 thereof. Herein, the switches in the first switch unit K1 may be a plurality of first transistors, the switches in the second switch unit K2 may be a plurality of second transistors, and the switches in the third switch unit K3 may be a plurality of third transistors.

In this embodiment, the threshold voltage and the mobility of the driving transistor, and the aging of the organic light emitting diode in the pixel driving circuit are compensated by arranging an external compensation circuit on the display panel, such that the driving transistor and the organic light emitting diode can be compensated at the same time, thereby improving the brightness uniformity and the display effect of the display panel.

The structure of the pixel driving circuit of the present application is particularly described with reference to FIGS. 2-3.

Figure 2:
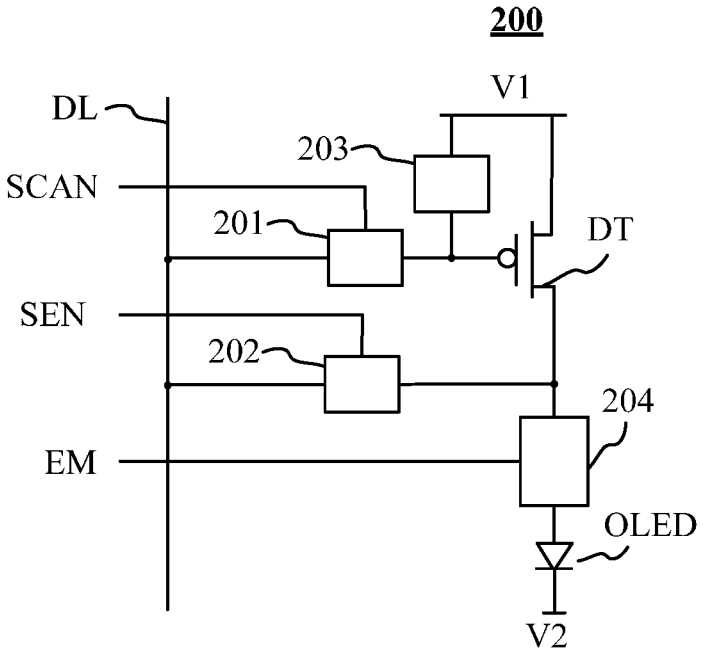
FIG. 2 shows a schematic structural diagram of a pixel driving circuit provided in an embodiment of the present application.

FIG. 2 shows a schematic structural diagram of an embodiment of a pixel driving circuit on a display panel according to the present application.

As shown in FIG. 2, the display panel provided in this embodiment includes a scan signal line SCAN, a data signal line DL, a light emission control signal line EM, a detection signal line SEN, a first source voltage signal line V1, and a second source voltage signal line V2. The scan signal line SCAN and the data signal line DL define a plurality of sub-pixels, and each sub-pixel includes a pixel driving circuit 200.

In this embodiment, the pixel driving circuit 200 includes a data write unit 201, a threshold compensation unit 202, a storage unit 203, a light emission control unit 204, a driving transistor DT, and an organic light emitting diode OLED. Here, the driving transistor DT includes three ports, that is, a gate, a first electrode, and a second electrode, in which the first electrode of the driving transistor DT is connected to the first source voltage signal line V1.

The data write unit 201 is connected to the data signal line DL and the gate of the driving transistor DT, and is electrically connected to the scan signal line SCAN. The data write unit 201 transmits a signal transmitted from the data signal line DL to the gate of the driving transistor DT, based on a signal transmitted from the scan signal line SCAN.

The threshold compensation unit 202 is connected to the data signal line DL and the second electrode of the driving transistor DT, and to the detection signal line SEN. The threshold compensation unit 202 transmits a signal transmitted from the data signal line DL to the second electrode of the driving transistor DT, based on a signal transmitted from the detection signal line SEN.

The storage unit 203 is connected to a first source voltage V1 and the gate of the driving transistor DT. The storage unit 203 is configured to store the signal transmitted to the gate of the driving transistor DT.

The light emission control unit 204 is connected between the second electrode of the driving transistor DT and an anode of the organic light emitting diode OLED, and is electrically connected to the light emission control signal line EM. The light emission control unit 204 controls the light emission of the organic light emitting diode OLED, based on a signal transmitted from the light emission control signal line EM.

The anode of the organic light emitting diode OLED is connected to the light emission control unit 204, and a cathode is connected to a second source voltage signal line V2.

Here, the external threshold compensation of the pixel driving circuit 200 is implemented by a threshold compensation circuit independent of the pixel driving circuit 200. An external threshold compensation phase may include a phase for threshold compensation of the driving transistor DT and a phase for signal compensation of the organic light emitting diode OLED.

The external threshold compensation of the driving transistor DT includes the following.

In a data write phase, the power supply unit 121 shown in FIG. 1 transmits a signal to the data signal line DL; the data write unit 201 transmits the signal transmitted from the data signal line DL to the gate of the driving transistor DT, based on a scan signal transmitted from the scan signal line SCAN; and the threshold compensation unit 202 transmits the signal transmitted from the data signal line DL to the second electrode of the driving transistor DT, based on a detection signal transmitted from the detection signal line SEN.

In a threshold voltage detection phase, the sampling unit 122 shown in FIG. 1 samples a signal from the data signal line DL, to determine the threshold of the driving transistor DT.

The signal compensation of the organic light emitting diode OLED includes the following.

In a data write phase, the power supply unit 121 shown in FIG. 1 transmits a current signal to the data signal line DL, and the signal transmitted from the data signal line DL is transmitted by the threshold compensation unit 202 based on a signal transmitted from the detection signal line SEN, and by the light emission control unit 204 based on a signal transmitted from the light emission control signal line EM, to the anode of the organic light emitting diode OLED.

In a voltage detection phase, the sampling unit 122 shown in FIG. 1 samples a voltage signal between the two terminals of the organic light emitting diode OLED, and determines a current density-voltage characteristic curve of the organic light emitting diode OLED according to the current signal provided by the power supply unit 121 shown in FIG. 1.

The sampling unit 122 shown in FIG. 1 determines a threshold compensation voltage for the pixel driving circuit 200, based on the threshold of the driving transistor DT and the current-voltage characteristic curve of the organic light emitting diode OLED.

It can be seen from the embodiment above that the threshold voltage and the mobility of the driving transistor and the voltage of the organic light emitting diode in the pixel driving circuit 200 at a moment can be determined by sampling the gate voltage of the driving transistor DT and the voltage between the two terminals of the organic light emitting diode OLED, and the threshold voltage and the mobility of the driving transistor and the aging of the organic light emitting diode can be compensated by an external circuit, thereby improving the display panel.

Figure 3:
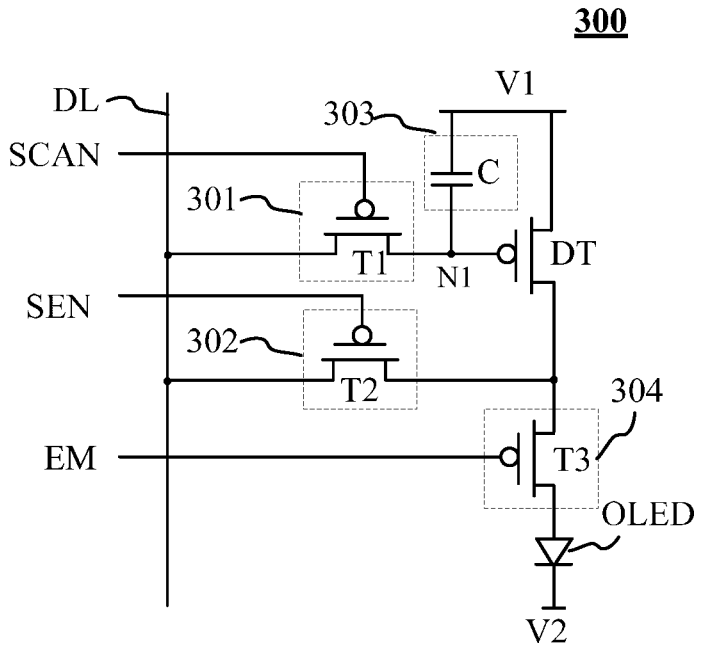
FIG. 3 shows another schematic structural diagram of a pixel driving circuit provided in an embodiment of the present application.

FIG. 3 shows a schematic structural diagram of another pixel driving circuit provided in an embodiment of the present application.

Similar to the embodiment shown in FIG. 2, the display panel provided in this embodiment also includes a scan signal line SCAN, a data signal line DL, a light emission control signal line EM, a detection signal line SEN, a first source voltage signal line V1, and a second source voltage signal line V2. The pixel driving circuit 300 also includes a data write unit 301, a threshold compensation unit 302, a storage unit 303, a light emission control unit 304, a driving transistor DT, and an organic light emitting diode OLED.

In addition, in FIG. 3, a first electrode of the driving transistor DT is connected to a first source voltage signal line V1. The data write unit 301 is connected between the data signal line DL and a gate of the driving transistor DT, and transmits a signal transmitted from the data signal line DL to the gate of the driving transistor DT, based on a first scan signal transmitted from the scan signal line SCAN. The threshold compensation unit 302 is connected between the data signal line DL and a second electrode of the driving transistor DT, and transmits the signal transmitted from the data signal line DL to the second electrode of the driving transistor DT, based on a detection signal transmitted from the detection signal line SEN. The storage unit 303 is connected to the first source voltage V1 and the gate of the driving transistor DT, and configured to store the signal transmitted to the gate of the driving transistor DT. The light emission control unit 304 is connected between the second electrode of the driving transistor DT and an anode of the organic light emitting diode OLED, and controls the light emission of the organic light emitting diode OLED, based on a light emission control signal transmitted from the light emission control signal line EM. The anode of the organic light emitting diode OLED is connected to the light emission control unit 304, and a cathode is connected to a second source voltage signal line V2.

As is different from the embodiment shown in FIG. 2, the structures of the data write unit 301, the threshold compensation unit 303, the storage unit 303, and the light emission control unit 304 in FIG. 3 are further specifically described in this embodiment.

In this embodiment in FIG. 3, the data write unit 301 can include a first transistor T1. Agate of the first transistor T1 is connected to the scan signal line SCAN, a first electrode of the first transistor T1 is connected to the data signal line DL, and a second electrode of the first transistor T1 is connected to the gate of the driving transistor DT.

The threshold compensation unit 302 includes a second transistor T2. A gate of the second transistor T2 is connected to the detection signal line SEN, a first electrode of the second transistor T2 is connected to the data signal line DL, and a second electrode of the second transistor T2 is connected to the second electrode of the driving transistor DT.

The storage unit 303 includes a storage capacitor C. One electrode of the storage capacitor C is connected to the gate of the driving transistor DT, and the other electrode of the storage capacitor C is connected to the first source voltage signal line V1.

The light emission control unit 304 includes a third transistor T3. A gate of the third transistor T3 is connected to the light emission control signal line EM, a first electrode of the third transistor T3 is connected to the second electrode of the driving transistor DT, and a second electrode of the third transistor T3 is connected to the anode of the organic light emitting diode OLED.

It should be noted that the first transistor T1, the second transistor T2, the third transistor T3, and the driving transistor DT shown in FIG. 3 may all be thin-film transistors or other devices having the same properties. Although in the embodiment shown in FIG. 3, the first transistor T1, the second transistor T2, the third transistor T3, and the driving transistor DT are all PMOS transistors, this is merely exemplary. In a practical application process, the type of the transistors can be set as desired by the application scenarios. In addition, where the same type of transistors is used in the pixel driving circuit, the transistors in the driving circuit can be fabricated at the same time, thereby simplifying the manufacturing process of the driving circuit.

According to the pixel driving circuit provided in this embodiment, the first electrodes of both the first transistor T1 of the data write unit 301 and the second transistor T2 of the threshold compensation unit 302 are connected to the data signal line DL, whereby the external threshold compensation of the pixel driving circuit can be accomplished.

Figure 4A:
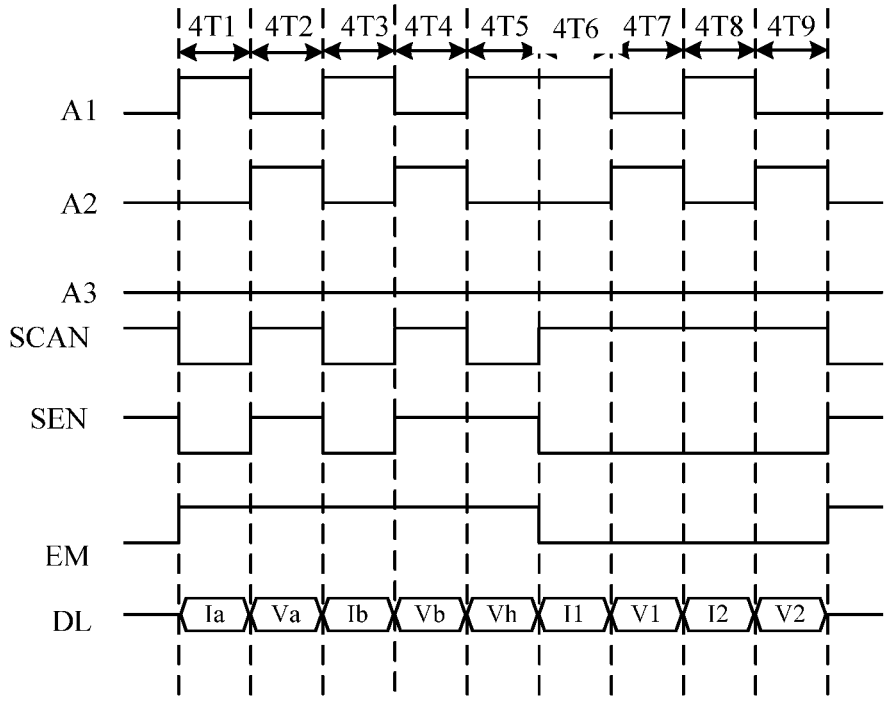
FIGS. 4*a*-4*b* show timing diagrams of a pixel driving circuit provided in an embodiment of the present application.
Figure 4B:
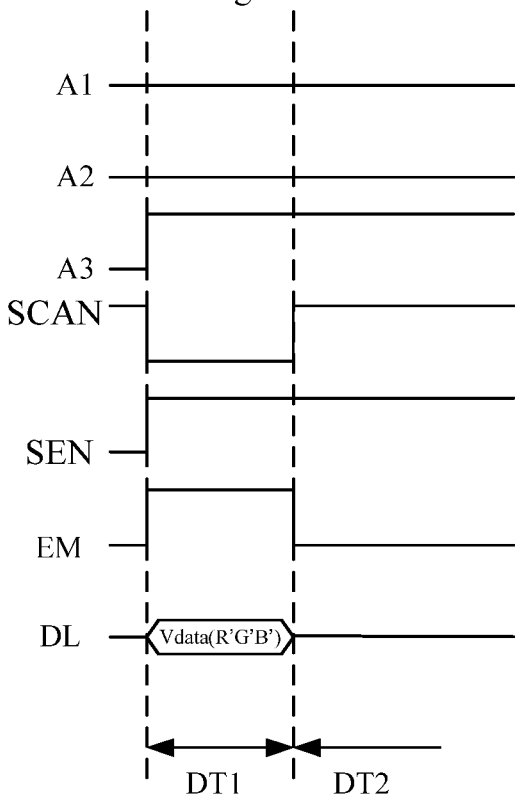

FIGS. 4*a* shows timing sequence of the pixel driving circuit as shown in FIG. 3 in a threshold compensation phase, and FIG. 4*b* shows timing sequence of the pixel driving circuit as shown in FIG. 3 in a display phase. FIGS. 5*a*-5*g* show equivalent circuits of the pixel driving circuit as shown in FIG. 3 in various work phases. The work principle for driving the pixel driving circuit as shown in FIG. 3 is described by way of examples in which the first transistor T1, the second transistor T2, the third transistor T3 and the driving transistor DT are all NOMS transistors, with reference to FIG. 1, and FIGS. 5*a*-5*f*.

Figure 5A:
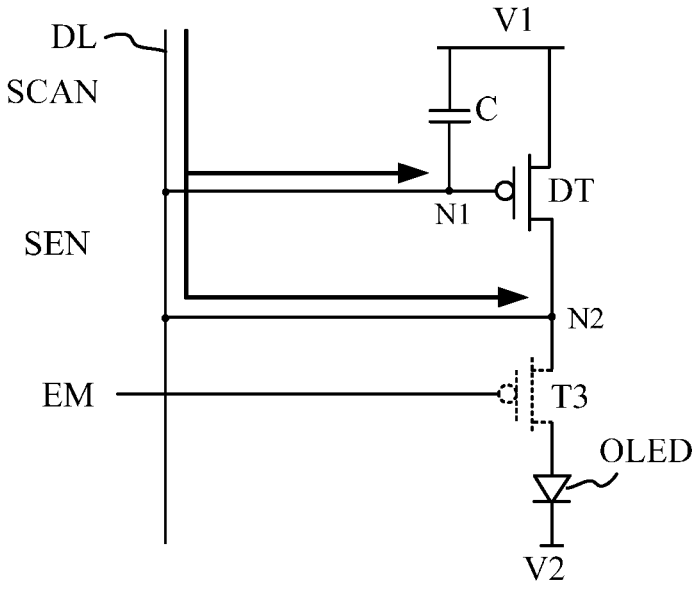
FIGS. 5*a*-5*g* show equivalent schematic structural diagrams of a pixel driving circuit provided in an embodiment of the present application in various work phases.

Referring to FIGS. 4*a* and 5*a*, in a first period 4T1, the scan signal line SCAN transmits a low level signal to the gate of the first transistor T1, and the detection signal line SEN transmits a low level signal to the gate of the second transistor T2, upon which the first transistor T1 and the second transistor T2 are turned on. A first switch unit K1 is turned on under the control of a control terminal A1 thereof, and a second switch unit K2 and a third switch unit K3 are turned off, upon which the power supply unit 121 of the external compensation circuit 120 transmits a fixed current signal $I_a$ to the data signal line DL connected thereto, and the data signal line DL transmits the signal via the first transistor T1 and the second transistor T2 to a first node N1 and a second node N2 of the pixel driving circuit, that is, the gate and the second electrode of the driving transistor DT. At this time, the current $I_{ds}$ between the first electrode and the second electrode of the driving transistor DT is $I_a$. Because the signal from the data signal line DL is supplied by a current source inside the power supply unit 121, the terminal voltages at the nodes N1 and N2 change constantly. After the power supply unit 121 detects that the voltage of the node N1 is unchanged relative to a reference potential, the first switch unit K1 is turned off, and the process proceeds to a next period.

Figure 5B:
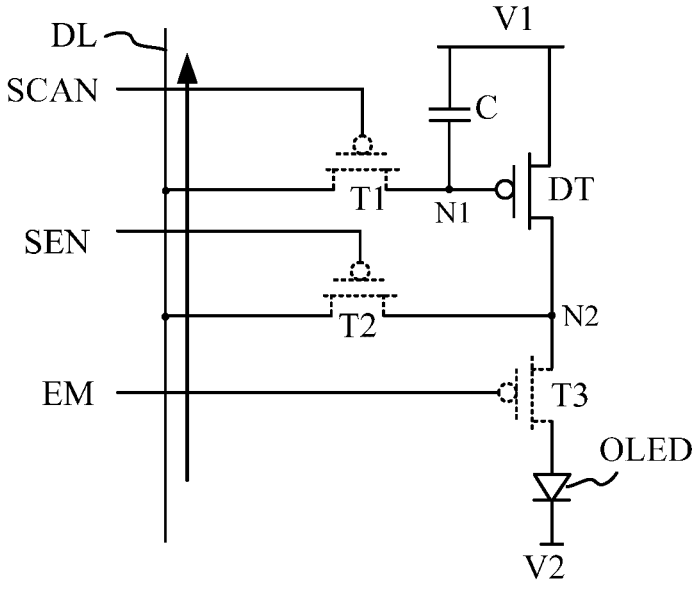

Referring to FIGS. 4*a* and 5*b*, in a second period 4T2, the first transistor T1 and the second transistor T2 are turned off in response to a high level signal transmitted from the scan signal line SCAN and a high level signal transmitted from the detection signal line SEN respectively. The second switch unit K2 is turned on, and the first switch unit K1 and the third switch unit K3 are turned off. The sampling unit 122 in the external compensation circuit 120 connected to the data signal line DL samples a voltage signal from the data signal line DL, and the voltage signal is a saturated voltage of the node N1 relative to the reference potential in the previous period, which is designated as $V_a$.

The timing in a third period 4T3 is the same as the timing in the first period 4T1. For the specific working mode, reference may be made to the description in the first period 4T1. At this time, the power supply unit 121 provides a current $I_b$ to the first node N1 and the second node N2 of the pixel driving circuit, and a current $I_{ds}$ between the first electrode and the second electrode of the driving transistor DT is $I_b$.

The timing in a fourth period 4T4 is the same as the timing in the second period 4T2. For the specific working mode, reference may be made to the description in the second period 4T2. At this time, the sampling unit 122 samples a voltage signal from the data signal line DL, that is, a saturated voltage of the node N1 relative to the reference potential in the third period 4T3, which is designated as $V_b$.

Figure 5C:
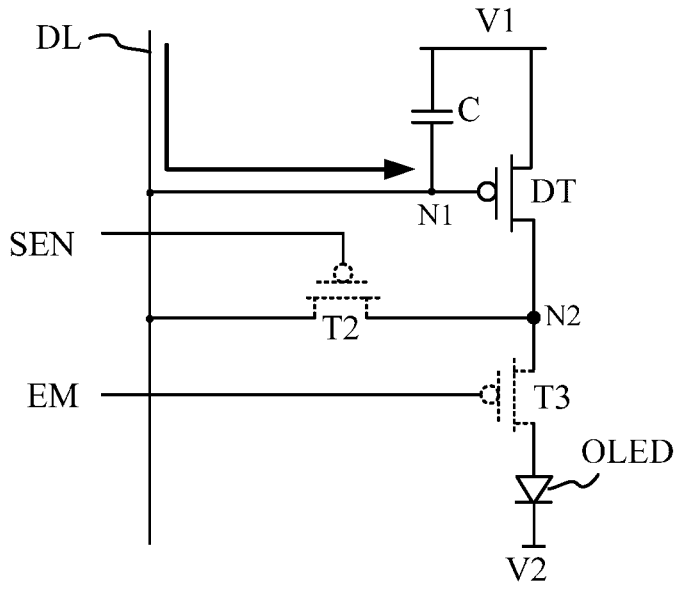

Referring to FIGS. 4*a* and 5*c*, in a fifth period 4T5, the first transistor T1 is turned on under the control a low level signal transmitted from the scan signal line SCAN, and the first switch unit K1 is turned on, upon which the power supply unit 121 transmits a high level signal generated by a voltage source inside the power supply unit 121 to the data signal line DL, and the high level signal is transmitted to the gate of the driving transistor DT, such that the driving transistor DT is turned off at a high level.

Figure 5D:
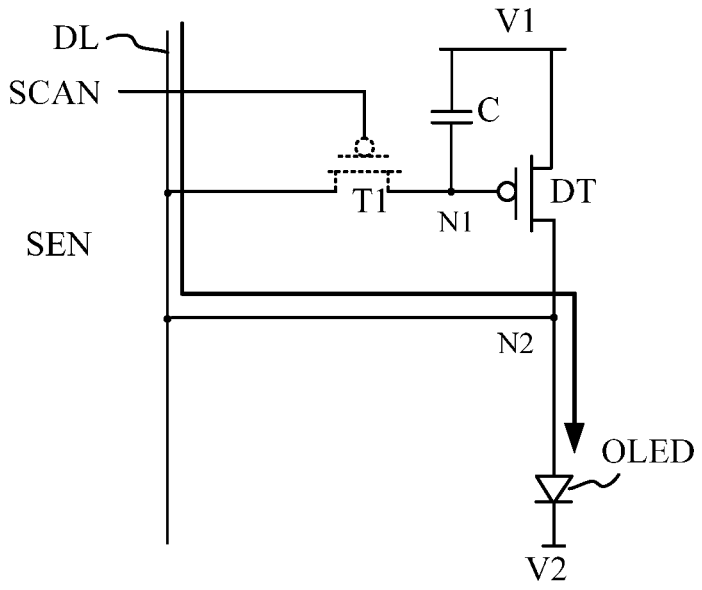

Referring to FIGS. 4*a* and 5*d*, in a sixth period 4T6, the second transistor T2 is turned on under the control of a low level signal transmitted from the detection signal line SEN, and the third transistor T3 is turned on under the control of a low level signal transmitted from the light emission control signal line. At this time, the first switch unit K1 is turned on, and the second switch unit K2 and the third switch unit K3 are turned off. The power supply unit 121 in the external compensation circuit 140 transmits a current signal $I_1$ to the data signal line DL, and the current signal $I_1$ is transmitted via the second transistor T2 connected to the data signal line DL and the third transistor T3 to the anode of the organic light emitting diode OLED.

Figure 5E:
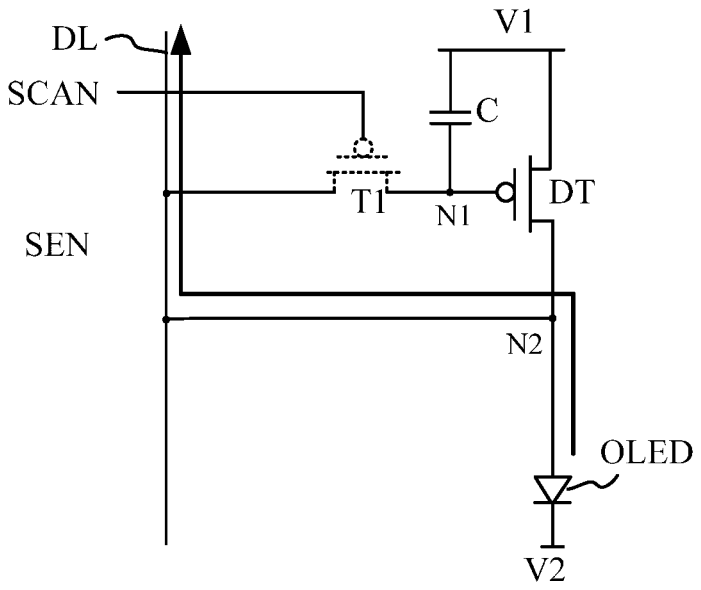

Referring to FIGS. 4*a* and 5*e*, in a seventh period 4T7, the second transistor T2 and the third transistor T3 are still turned on, the first switch unit K1 and the third switch unit K3 are turned off, and the second switch unit K2 is turned on under the control of a control terminal A2 thereof. At this time, the sampling unit 122 of the external compensation circuit 12 samples a voltage between the two terminals of the organic light emitting diode GELD, and the sampled voltage is designated as $V_1$.

The timing in an eighth period 4T8 is the same as the timing in the sixth period 4T6. For the specific working mode, reference may be made to the description in the sixth period 4T6. At this time, the power supply unit 121 provides a current $I_2$ to the organic light emitting diode OLED of the pixel driving circuit.

The timing in a ninth period 4T9 is the same as the timing in the seventh period 4T7. For the specific working mode, reference may be made to the description in the seventh period 4T7. At this time, the sampling unit 122 samples a voltage between the two terminals of the organic light emitting diode GELD, and the sampled voltage is designated as $V_2$.

Based on the two sets of data determined in the first period 4T1 to the fourth period 4T4, in which one set of data is the current Ia between the first electrode and the second electrode of the driving transistor DT and the corresponding voltage Va of the first node, that is, the gate node N1, relative to the reference potential; and the other set of data is the current Ib between the first electrode and the second electrode of the driving transistor DT and the corresponding voltage Vb of the first node, that is, the gate node N1, relative to the reference potential, and according to the formula $Ids=k(Vgs-Vth)^2$, in which k denotes a constant determined by the mobility, the parasitic capacitance, and the channel length, Ids is the current between the first electrode and the second electrode of the driving transistor DT, Vgs is the voltage between the gate and the second electrode of the driving transistor DT, and Vth is the threshold voltage of the driving transistor DT; and here, Ids=Ia, and Vgs=V1−Va; or Ids=Ib, Vgs=V1−Vb, and V1 is the first source voltage signal generated by the first source voltage signal line, the sampling unit 142 determines the constant K and the threshold voltage Vth of the driving transistor DT at this time. The characteristic curve of the driving transistor at this time is compared with a characteristic curve of the driving transistor DT previously stored on the display panel, to determine the variations in the threshold voltage Vth and the mobility needed to be compensated.

In this embodiment, the work in the sixth period 4T6 and the seventh period 4T7 may be repeated multiple times, to obtain multiple currents Ik of the organic light emitting diode OLED and voltages Vk corresponding to the currents between the two terminals of the organic light emitting diode OLED. According to the currents I1, I2, . . . Ik of the organic light emitting diode OLED, and the voltages V1, V2, . . . Vk corresponding to the currents between the two terminals of the organic light emitting diode OLED obtained in the sixth period 4T6 to the ninth period 4T9, a current density-voltage characteristic curve of the organic light emitting diode OLED at this time is determined, in which the current density is the current flowing through one unit area of the organic light emitting diode. The current density-voltage characteristic curve is compared with a current density-voltage characteristic curve of the organic light emitting diode OLED previously stored on the display panel, to determine a voltage needed to be compensated between the two terminals of the organic light emitting diode OLED.

According to the variations in the threshold voltage Vth and the mobility of the driving transistor DT and the voltage needed to be compensated between the two terminals of the organic light emitting diode OLED determined by the sampling unit 142, a compensated voltage of a data signal is determined, and converted by an analog-to-digital converter into compensated data.

Figure 5F:
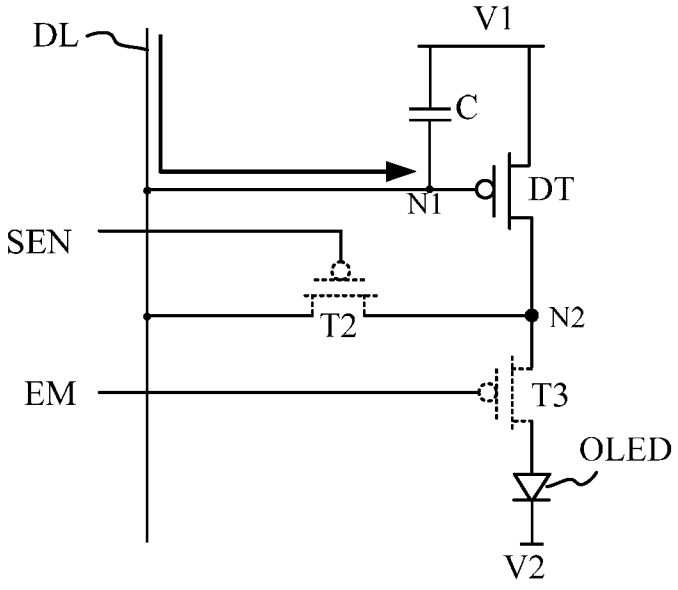

Referring to FIGS. 4*b* and 5*f*, in a light emitting and display phase 4D1, the first transistor T1 is turned on under the control of a low level signal transmitted from the scan signal line SCAN, the second transistor T2 is turned off based on a high level signal transmitted from the detection signal line SEN, and the third transistor T3 is turned off based on a high level signal transmitted from the light emission control signal line EM. The third switch unit K3 is turned on, and the first switch unit K1 and the second switch unit K2 are turned off. The data signal generation unit 123 converts modulated digital video data RGB into a data voltage, and provides the data voltage to the data signal line DL. The differences in the variations of the mobility of the driving transistors DT and the differences in the variations of the organic light emitting diodes OLED are reflected in the data voltage, and the data voltage is applied to the first node N1 of the pixel driving circuit.

Figure 5G:
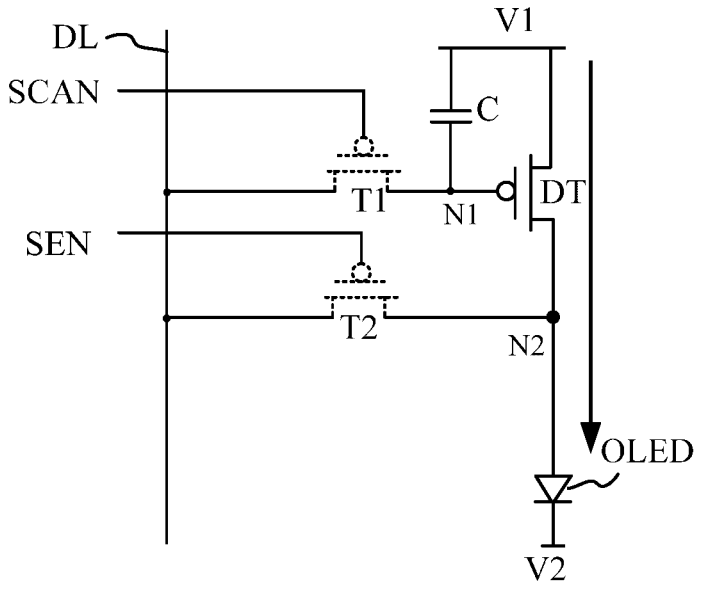

Referring to FIGS. 4*b* and 5*g*, in a light emitting and display phase 4D2, the third transistor T3 is turned on based on a high level signal transmitted from the light emission control signal line EM, the first transistor T1 is turned off based on a high level signal transmitted from the scan signal line SCAN, and the second transistor T2 is turned off based on a high level signal transmitted from the detection signal line SEN. The third switch unit K3 is turned on, and the first switch unit K1 and the second switch unit K2 are turned off. At this time, the potential at the first node N1 is maintained to be the data voltage. So, a drive current Ioled flowing in the organic light emitting diode OLED is expressed by a formula below:

$$Ioled=k(Vgs-Vth)^2=k(V1-V\text{data}-Vth)^2$$

in which k denotes a constant determined by the mobility, the parasitic capacitance, and the channel length, Vgs denotes the voltage between the gate and the second electrode of the driving transistor DT, V1 denotes the voltage generated by the first source voltage signal line V1, Vdata is the data voltage, and Vth is the threshold voltage of the transistor DT. As is detailed above, because the differences in the variations of the organic light emitting diodes OLED and the differences in the variations of driving transistors DT are reflected in the data voltage Vdata, the drive current Ioled according to the present invention is non-dependent on the varying differences.

Figure 6:
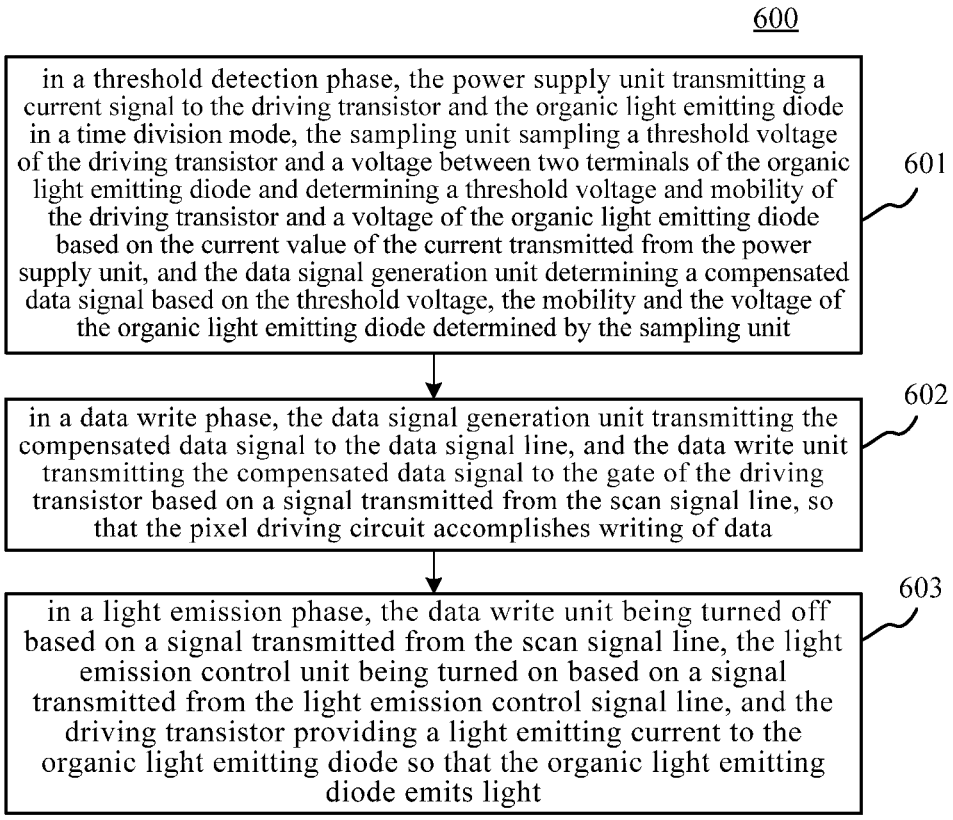
FIG. 6 shows a flow chart of a driving method for a display panel provided in an embodiment of the present application.

The present application further provides a pixel compensation method for the pixel driving circuit as shown in FIG. 3, applied in the display panel as shown in FIG. 1. The display panel includes an external compensation circuit for compensating the pixel driving circuit as shown in FIG. 3, a scan signal line, a light emission control signal line, and a detection signal line. The external compensation circuit includes a power supply unit, a sampling unit, and a data signal generation unit. The pixel driving circuit in this embodiment includes a data write unit, a threshold compensation unit, a light emission control unit, a driving transistor, and a light emitting diode. Particularly, as shown in FIG. 6, the method for compensating the pixel driving circuit includes the following steps.

Step 601: in a threshold detection phase, the power supply unit transmitting a current signal to the driving transistor and the organic light emitting diode in a time division mode, the sampling unit sampling a threshold voltage of the driving transistor and a voltage between two terminals of the organic light emitting diode and determining a threshold voltage and mobility of the driving transistor and a voltage of the organic light emitting diode based on the current value of the current transmitted from the power supply unit, and the data signal generation unit determining a compensated data signal based on the threshold voltage, the mobility and the voltage of the organic light emitting diode determined by the sampling unit.

Step 602: in a data write phase, the data signal generation unit transmitting the compensated data signal to the data signal line, and the data write unit transmitting the compensated data signal to the gate of the driving transistor based on a signal transmitted from the scan signal line, so that the pixel driving circuit accomplishes writing of data.

In this step, the data signal generation unit transmits the compensated data signal determined in the threshold compensation phase to the data signal line. The data write unit is turned on under the control of a signal transmitted from the scan signal line, and the threshold compensation unit and the light emission control unit are turned off. The data write unit transmits the signal from the data signal line to the gate of the driving transistor, so the writing of data is accomplished by the pixel driving circuit.

Step 603: in a light emission phase, the data write unit being turned off based on a signal transmitted from the scan signal line, the light emission control unit being turned on based on a signal transmitted from the light emission control signal line, and the driving transistor providing a light emitting current to the organic light emitting diode so that the organic light emitting diode emits light.

In some optional implementations of this embodiment, the threshold detection phase may further include a first detection phase, and the first detection phase includes a first current transmission sub-phase, and a threshold voltage detection sub-phase.

In the first current transmission sub-phase, the power supply unit transmits a first current signal to the data signal line, the data write unit is turned on under control of a signal transmitted from the scan signal line and transmits the signal transmitted from the data signal line to the gate of the driving transistor, and the threshold compensation unit is turned on under control of a signal transmitted from the detection signal line and transmits the signal from the data signal line to the second electrode of the driving transistor.

In the threshold voltage detection sub-phase, the data write unit and the threshold compensation unit are turned off respectively based on a signal transmitted from the scan signal line and a signal transmitted from the detection signal line, and the sampling unit samples a voltage signal from the data signal line.

The first current transmission sub-phase and the threshold voltage detection sub-phase are repeated multiple times. The sampling unit determines the threshold voltage of the transistor according to the current signals transmitted on the power supply unit and the sampled voltage signals by comparing them with the transistor properties previously stored in a storage circuit of the display panel.

In some optional implementations of this embodiment, the threshold detection phase may further include a second detection phase, and the second detection phase includes a second current transmission sub-phase and a voltage detection sub-phase.

In the second current transmission sub-phase, the power supply unit transmits a second current signal to the data signal line, the data write unit is turned off under control of a signal transmitted from the scan signal line, the threshold compensation unit is turned on under control of a signal transmitted from the detection signal line, the light emission control unit is turned on under control of a signal transmitted from the light emission control signal line, and the signal from the data signal line is transmitted to the anode of the organic light emitting diode.

In the voltage detection sub-phase, the sampling unit samples a voltage signal from the data signal line, that is, the voltage signal between two terminals of the organic light emitting diode.

The second current transmission sub-phase and the voltage detection sub-phase are repeated multiple times. The sampling unit determines a current density-voltage characteristic curve of the organic light emitting diode based on multiple second current signals transmitted from the power supply unit and multiple sampled voltages between the input terminal and the output terminal of the organic light emitting diode, and compares it with a previously stored current density-voltage characteristic curve, to determine the variation in the voltage of the organic light emitting diode.

In the driving method provided in the embodiment of the present application, the threshold of the driving transistor and also the ageing of the organic light emitting diode in the pixel driving circuit can be compensated by an external compensation circuit, thereby increasing the display precision of the display panel.

Figure 7:
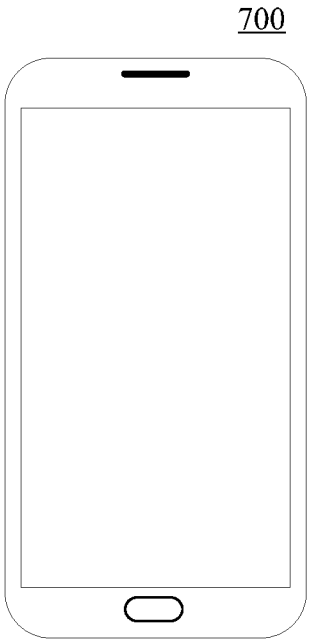
FIG. 7 shows a schematic diagram of a display device provided in an embodiment of the present application.

As shown in FIG. 7, the present application further provides an organic light emitting display device 700. The organic light emitting display device includes an organic light emitting display panel depicted in FIG. 1. The organic light emitting display device 700 is applicable to various devices such as a smart phone, a tablet terminal, a portable telephone terminal, a notebook type personal computer, and a game console, etc.

What have been described above are only preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. A display panel, comprising:

a plurality of data signal lines;

a plurality of scan signal lines disposed to intersect the plurality of data signal lines to define a plurality of sub-pixels in an array;

wherein the plurality of sub-pixels each comprises a pixel driving circuit, wherein the pixel driving circuit includes a driving transistor and an organic light emitting diode, wherein the organic light emitting diode has a threshold voltage for turning on; and an external compensation circuit comprising a power supply unit, a sampling unit and a data signal generation unit, wherein the external compensation circuit connects to the plurality of data signal lines, and transmits a compensated data signal via the plurality of data signal lines to the pixel driving circuit of each of the plurality of sub-pixels in a number of periods to compensate for the threshold voltage in a threshold compensation phase;

wherein the power supply unit provides a current signal to the driving transistor and/or the organic light emitting diode of each of the plurality of sub-pixels;

wherein the sampling unit samples a voltage signal of the driving transistor and/or the organic light emitting diode of each of the plurality of sub-pixels based on a current signal provided by the power supply unit, and compares the voltage signal with a pre-stored characteristic curve of the driving transistor and/or a characteristic curve of the organic light emitting diode of each of the plurality of sub-pixels to determine a degraded voltage of the driving transistor and/or the organic light emitting diode; and wherein the data signal generation unit generates the compensated data signal based on the degraded voltage of the driving transistor and/or the organic light emitting diode of each of the plurality of sub-pixels determined by the sampling unit, and provides the compensated data signal to the pixel driving circuits of each of the plurality of sub-pixels;

wherein the display panel further comprising a first switch unit, a second switch unit, and a third switch unit;

wherein the first switch unit comprises a plurality of first switches, each first switch-is turned on or turned off between the power supply unit and an associated data signal line of the plurality of data signal lines;

wherein the second switch unit comprises a plurality of second switches, each second switch is turned on or turned off between the sampling unit and an associated data signal line of the plurality of data signal lines; and wherein the third switch unit comprises a plurality of third switches, each third switch is turned on or turned off between the data signal generation unit and an associated data signal line of the plurality of data signal lines;

wherein in a first period of the threshold compensation phase, the first switch unit is turned on and sends out a first signal under control of a control terminal of the first switch unit, the second switch unit and the third switch unit are turned off, the power supply unit of the external compensation circuit transmits a fixed current signal to the associated data signal line connected thereto in response to the first signal from the control terminal of the first switch unit, and the associated data signal line transmits the current signal to a first node and a second node of the pixel driving circuit, terminal voltages at the first node and the second node change accordingly, after the power supply unit detects that a voltage of the first node is unchanged relative to a reference potential, the first switch unit is turned off;

wherein in a second period of the threshold compensation phase, the second switch unit is turned on and sends out a second signal under control of a control terminal of the second switch unit, the first switch unit and the third switch unit are turned off, sampling unit of the external compensation circuit connected to the data signal line samples a voltage signal from the data signal line, and the voltage signal is a saturated voltage of the first node relative to the reference potential in the previous period; and wherein a timing in a third period of the threshold compensation phase is the same as the first period of the threshold compensation phase, and a timing in a fourth period of the threshold compensation phase is the same as the second period of the threshold compensation phase, wherein the third switch unit is turned on and sends out a third signal under control of a control terminal of the third switch unit, the first switch unit and the second switch unit are turned off, wherein a date signal generated by the data signal generation unit is transmitted to the associated data signal line, in response to the third signal from the control terminal of the third switch unit.

2. The display panel according to claim 1, wherein the power supply unit comprises a current source and/or a voltage source.

3. The display panel according to claim 1, wherein each of the plurality of first switches, the plurality of second switches, and the plurality of third switches is a transistor.

4. The display panel according to claim 1, wherein the external compensation circuit further comprises an analog-to-digital converter configured to convert an analog signal sampled by the sampling unit into a digital signal, and transmit the converted signal to the data signal generation unit.

5. The display panel according to claim 1, further comprising a display region and a non-display region, wherein the external compensation circuit is arranged in the non-display region, and the sub-pixels are arranged in the display region.

6. The display panel according to claim 1, further comprising, a light emission control signal line, a detection signal line, a first source voltage signal line, and a second source voltage signal line.

7. The display panel according to claim 6, the pixel driving circuit further comprises a data write unit, a threshold compensation unit, a storage unit, a light emission control unit and a first and a second electrodes;

wherein the first electrode of the driving transistor is connected to the first source voltage signal line;

wherein the data write unit connects to one associated data signal line and the gate of the driving transistor, and transmits a signal from the associated data signal line to the gate of the driving transistor based on a signal from the scan signal line;

wherein the threshold compensation unit connects to the associated data signal line and the second electrode of the driving transistor, and transmits the signal from the associated data signal line to the second electrode of the driving transistor based on a signal from the detection signal line;

wherein the storage unit is connected to the driving transistor and the first source voltage signal line, and configured to store signals transmitted to the driving transistor;

wherein the light emission control unit connects to the second electrode of the driving transistor and an anode of the organic light emitting diode, and controls light emission of the organic light emitting diode based on a signal from the light emission control signal line; and a cathode of the organic light emitting diode is connected to the second source voltage signal line.

8. The display panel according to claim 7, wherein the data write unit comprises a first transistor, a gate of the first transistor is connected to the scan signal line, a first electrode of the first transistor is connected to the data signal line, and a second electrode of the first transistor connects to the gate of the driving transistor.

9. The display panel according to claim 7, wherein the threshold compensation unit comprises a second transistor, a gate of the second transistor is connected to the detection signal line, a first electrode of the second transistor is connected to an associated data signal line, and a second electrode of the second transistor is connected to the second electrode of the driving transistor.

10. The display panel according to claim 7, wherein the storage unit comprises a storage capacitor, a first terminal of the storage capacitor is connected to the gate of the driving transistor, and a second terminal of the storage capacitor is connected to the first source voltage signal line.

11. The display panel according to claim 7, wherein the light emission control unit comprises a third transistor, a gate of the third transistor is connected to the light emission control signal line, a first electrode of the third transistor is connected to the second electrode of the driving transistor, and a second electrode of the third transistor is connected to the anode of the organic light emitting diode.

12. A method for driving the display panel according to claim 7, the method comprising:

a threshold detection phase comprising:

transmitting a current signal from the power supply unit to the driving transistor and the organic light emitting diode in a time division mode;

sampling with the sampling unit a threshold voltage of the driving transistor and a voltage between two terminals of the organic light emitting diode;

determining a threshold voltage and mobility of the driving transistor and a voltage of the organic light emitting diode based on the current signal transmitted from the power supply unit;

determining a compensated data signal based on the threshold voltage by the data signal generation unit;

determining the mobility and the voltage of the organic light emitting diode with the sampling unit;

a data write phase comprising:

transmitting the compensated data signal from the data signal generation unit to the data signal line;

transmitting the compensated data signal to the gate of the driving transistor by the data write unit based on a signal transmitted from the scan signal line, so that the pixel driving circuit accomplishes writing of data; and a light emission phase comprising:

turning off the data write unit based on a signal transmitted from the scan signal line;

turning on the light emission control unit based on a signal transmitted from the light emission control signal line; and providing a light emitting current to the organic light emitting diode to emit light by the driving transistor.

13. The method according to claim 12, wherein the threshold detection phase further comprises:

a first detection phase, comprising a first current transmission sub-phase and a threshold voltage detection sub-phase, wherein the first current transmission sub-phase comprises:

transmitting a first current signal from the power supply unit to the data signal line;

turning on the data write unit under control of a signal transmitted from the scan signal line;

transmitting the signal from the associated data signal line to the gate of the driving transistor;

turning on the threshold compensation unit under control of a signal transmitted from the detection signal line; and transmitting the signal from the associated data signal line to the second electrode of the driving transistor;

and wherein the threshold voltage detection sub-phase comprises:

turning off the data write unit and the threshold compensation unit respectively based on a signal transmitted from the scan signal line and a signal transmitted from the detection signal line; and sampling a voltage signal from the data signal line by the sampling unit.

14. The method according to claim 13, wherein the threshold detection phase further comprises a second detection phase, including a second current transmission sub-phase and a voltage detection sub-phase: wherein the second current transmission sub-phase comprises:

transmitting a second current signal from the power supply unit to the associated data signal line;

turning off the data write unit under control of a signal transmitted from the scan signal line;

turning on the threshold compensation under control of a signal transmitted from the detection signal line;

turning on the light emission control unit under control of a signal transmitted from the light emission control signal line;

transmitting the signal from the data signal line to the anode of the organic light emitting diode; and wherein voltage detection sub-phase comprises, sampling a voltage signal from the associated data signal line by the sampling unit, to obtain the voltage signal between two terminals of the organic light emitting diode.

15. A display device, comprising the display panel according to claim 1.

* * * * *